219-121 SR
8/18/87 XR 4,687,539

United States Patent [19]
Burns et al.

[11] Patent Number: 4,687,539
[45] Date of Patent: Aug. 18, 1987

[54] END POINT DETECTION AND CONTROL OF LASER INDUCED DRY CHEMICAL ETCHING

[75] Inventors: Francis C. Burns, Endicott; Russell W. Dreyfus, Mt. Kisco; John R. Susko, Owego, all of N.Y.

[73] Assignee: International Business Machines Corp., Armonk, N.Y.

[21] Appl. No.: 924,519

[22] Filed: Oct. 29, 1986

[51] Int. Cl.[4] ..... C23F 1/02; B44C 1/22; C03C 15/00; C03C 25/06

[52] U.S. Cl. ..... 156/626; 156/643; 156/646; 156/656; 156/659.1; 156/345; 204/192.32; 204/298; 219/121 LF; 219/121 LJ; 219/121 LZ; 219/121 LM

[58] Field of Search ..... 156/626, 627, 643, 656, 156/659.1, 646, 345; 219/121 LE, 121 LF, 121 LH, 121 LJ, 121 LS, 121 LZ, 121 LM; 204/192.32, 298

[56] References Cited

U.S. PATENT DOCUMENTS 4,377,436 3/1983 Donnelly et al. ..... 156/626
4,394,237 7/1983 Donnelly et al. ..... 204/192.32
4,579,623 4/1986 Suzuki et al. ..... 156/626

*Primary Examiner*—William A. Powell
*Attorney, Agent, or Firm*—Milton M. Field

[57] ABSTRACT

An end point detection technique indicates when a pulsed excimer laser, operating on a chromium clad copper substrate in the presence of chlorine gas, has etched through the chromium layer. The excimer laser vaporizes successive layers of the chromium chloride reaction product, which form on the region being etched, until, when all of the chromium has been removed from the region, a copper chloride reaction product layer forms on the region and is vaporized. A dye laser directs a probe beam into a zone spaced above the region being etched and is pulsed about 12 microseconds after each pulse of the excimer laser to allow time for the vaporized reaction products to reach the zone. The probe beam has a first wavelength of 433.3 nm. which induces the vaporized copper chloride in the zone to fluoresce at a second wavelength of 441.2 nm. A narrow band photodetector detects the fluoresced 441.2 nm. wavelength light to indicate that the end point has been reached, and the detection of the end point is used to terminate the pulsing of the excimer laser to end the etching process.

20 Claims, 3 Drawing Figures

END POINT DETECTION AND CONTROL OF LASER INDUCED DRY CHEMICAL ETCHING

BACKGROUND OF THE INVENTION

1. Field of the Invention

This invention relates to laser induced dry chemical etching and, more particularly, to a method and apparatus for indicating when a pulsed etching laser, operating in the presence of a reactive gas, has etched through a layer of a first material superposed on a second material and for controlling the etching laser to terminate the etching operation in response to detection of this end point.

2. Brief Description of the Prior Art

Laser induced dry chemical etching, as is shown, for example, in U.S. Pat. No. 4,490,210 issued to Chen et al and U.S. Pat. No. 4,490,211 issued to Chen et al, both assigned to the assignee of this application, is used to etch metallized substrates in the presence of a reactive gas. The substrate is exposed to a selected gas, such as a halogen gas, which reacts spontaneously with the metal forming a solid reaction product with the metal by partial consumption of the metal. A pulsed beam of radiation of a wavelength suitable for absorption by the reaction product and/or the metal thereunder is applied in a desired pattern to vaporize the reaction product and thereby selectively etch the metal.

It is often useful to apply this technique to a substrate having a first material superposed on a second material to remove the first material selectively to expose an area of the second material. When, for example, a chromium-copper-chromium substrate is prepared for soldering, the top chromium layer must be removed without damage to the underlying copper layer. However, it has been difficult to determine accurately when the removal of the first material has reached an end point so that the etching beam may be shut off without undue damage to the layer of second material. The problem has been particularly acute with respect to the chromium-copper-chromium substrate example, because the exposed copper etches several orders of magnitude faster than the chromium.

There have been a number of suggestions in the prior art for end point detection while etching specific layers on thin film devices. U.S. Pat. No. 4,394,237 issued to Donnelly et al teaches the use of laser induced fluorescence for end point detection in connection with plasma reaction etching employing essentially continuously applied (including R.F.) plasma reactions. The signals generated with such reaction ion etching tend to be small (see R. Walkup et al, *Appl. Phys. Lett.*, Vol. 45, p. 372, 1984), often corresponding to about $10^8$ diatomics/cm.$^3$. As a result, approximately 0.1 second of signal averaging may be required before the reaction can be stopped. Donnelly et al do not teach how laser induced fluorescence may be applied to laser etching.

Bennett et al application Ser. No. 878,144, filed June 25, 1986, assigned to the same assignee as the present application, also teaches using laser induced fluorescence to detect and control the reactive ion etch-through of a given layer in a wafer. A large change in the concentration of a selected minor species from the wafer in the etching plasma is detected for end point detection. When the large change in the selected minor species concentration is detected, the RF electrodes for the reactor are automatically de-energized. Bennett et al thus do not teach the application of laser induced fluorescence to laser induced dry chemical etching.

U.S. Pat. No. 4,198,261 issued to Busta et al also discloses a technique for detecting the end point of a plasma etching process. A laser probe is used to generate an interference pattern due to reflected and refracted light waves in the surface layer. Laser-induced fluorescence is not used.

Another end point detection technique is shown in U.S. Pat. No. 4,393,311 issued to Feldman et al. A surface is exposed to a beam of probe radiation and the infrared, visible or UV radiation emitted by excited particles desorbed from the surface is detected. The self-luminosity depended upon by Feldman et al would be too low to be useful for detecting an end point in the case of a chromium-copper laser etching using chlorine gas.

SUMMARY OF THE INVENTION

It is an object of the invention to provide a method and apparatus for indicating when a pulsed etching laser, operating in the presence of a reactive gas, has etched through a layer of first material superposed on a second material and for controlling the etching laser to bring the etching operation to a close in response to the detection of this end point.

As indicated, the invention relates to a process of laser induced dry chemical etching. A substrate having a layer of a first material superposed on a second material is mounted in a reaction chamber containing a reactive gas so that the first material and the reactive gas form a first solid reaction product layer on the first material by at least partial consumption of the layer of first material. An etching excimer laser is pulsed to apply, in a predetermined pattern corresponding to a region of the substrate, a beam of laser radiation to the region to vaporize the first solid reaction product layer in the region to expose the layer of the first material which again forms a layer of the first solid reaction product with the reactive gas in the region. The etching laser is pulsed repeatedly to vaporize successively the first solid reaction product layers from the region after they form following successive vaporizations thereof to expose the first material. After all of the first material in the region has been removed, a second reaction product layer is formed by the second material and the reactive gas in the region and is vaporized by the next pulse of the excimer laser.

According to the invention, this end point is detected by using radiation-induced fluorescence to indicate the presence of the vaporized second reaction product in the reaction chamber. After a delay following each pulsing of the etching laser, probe beam means, comprising a tunable dye laser, is pulsed to direct a beam of narrow band light into a zone spaced from the region being etched. The probe beam has a first wavelength which induces the vaporized second reaction product to fluoresce at a second wavelength. A narrow band photodetector detects light of the second wavelength to develop a signal indicating that the end point has been reached. This signal is integrated over a period of time which is two to three times the fluorescent lifetime of the light of the second wavelength. When the integrated signal exceeds a predetermined threshold, the etching laser is shut off.

The delay in pulsing the probe beam means is of such a magnitude that the vaporized reaction products ejected from the region being etched have time to reach the zone being probed by the probe beam. Because the vaporized etch product is concentrated not only by position, but also by time, a properly timed probe beam maximizes the signal detected by the photodetector. In the aforementioned example of a chromium-copper-chromium substrate etched by an excimer laser in the presence of chlorine gas with the pulsing of a probe beam of 433.3 nm. wavelength delayed by 12 microseconds following the pulsing of the excimer laser and with the zone being probed spaced 1 to 2 cm. from the region being etched, the vaporized copper chloride reaction product can reach a density of about $10^{15}$ particles/cm.$^3$ in the probed zone by just etching off a monolayer from an area of about 1 cm.$^2$. As a result the fluoresced light of the second wavelength (441.2 nm. in the case of copper chloride) is of high density, and the photodetector develops a relatively large signal. A useful end point indication signal may therefore be developed by an integrator over a very short period corresponding to about two to three fluorescent lifetimes of the light of the second wavelength light (about 100 nanoseconds), and the etching reaction may be stopped within microseconds.

BRIEF DESCRIPTION OF THE DRAWING

These and other objects, features and advantages of the invention will be more fully appreciated with reference to the accompanying figures, in which.

DETAILED DESCRIPTION OF THE PREFERRED EMBODIMENTS

The present invention involves the application of the process of laser induced dry chemical etching as shown in Chen et al U.S. Pat. No. 4,490,210 and Chen et al U.S. Pat. No. 4,490,211, the disclosures of which are incorporated by reference herein, to the case of a multilayer substrate having a layer of a first material superposed over a layer of a second material. A thin layer of a first solid reaction product is formed on the exposed surface of the first material by reacting the first material with a selective reactive gas, and the layer of the first reaction product is irradiated in a selected pattern corresponding to a region of the substrate to be etched with a pulse of laser radiation having a wavelength which can be absorbed by the reaction product and/or by the first material thereunder. Wherever the laser radiation strikes, due to excitation and heating caused by absorption of the radiation, the thin layer of the first reaction product is driven off exposing a fresh layer of the first material. A new layer of the first solid reaction product is then formed on the freshly exposed first material, as before, by reaction with the gas. This new layer of the first reaction product is, in turn, removed by irradiation with an additional pulse of the laser radiation. The laser is repeatedly pulsed until all of the first material is etched from the region of the substrate to expose the layer of second material. A thin layer of a second reaction product is then formed on the region by reacting the second material with the gas. The next pulse and subsequent pulses of laser radiation will then vaporize and drive off the layer of the second reaction product.

The end point detection process of the present invention is based on the detection of the presence of this vaporized second reaction product which, by its presence, indicates that enough of the first material has been removed from the region of the substrate being etched to expose some of the second material. The vaporized second reaction product is detected by means of radiation induced fluorescence. By irradiating a zone spaced from the region being etched with a probe beam having a particular first wavelength which, when it irradiates the vaporized second reaction product, will be absorbed and cause the second reaction product to fluoresce at a second wavelength unique to the second reaction product, the end point is detected by sensing light of the second wavelength with narrow band photodetector means. In order to maximize the intensity of the fluoresced light and, hence, the signal generated by the photodetector means, probe beam pulses are timed to coincide with the arrival in the zone of the vaporized reaction products ejected from the region.

Figure 1:
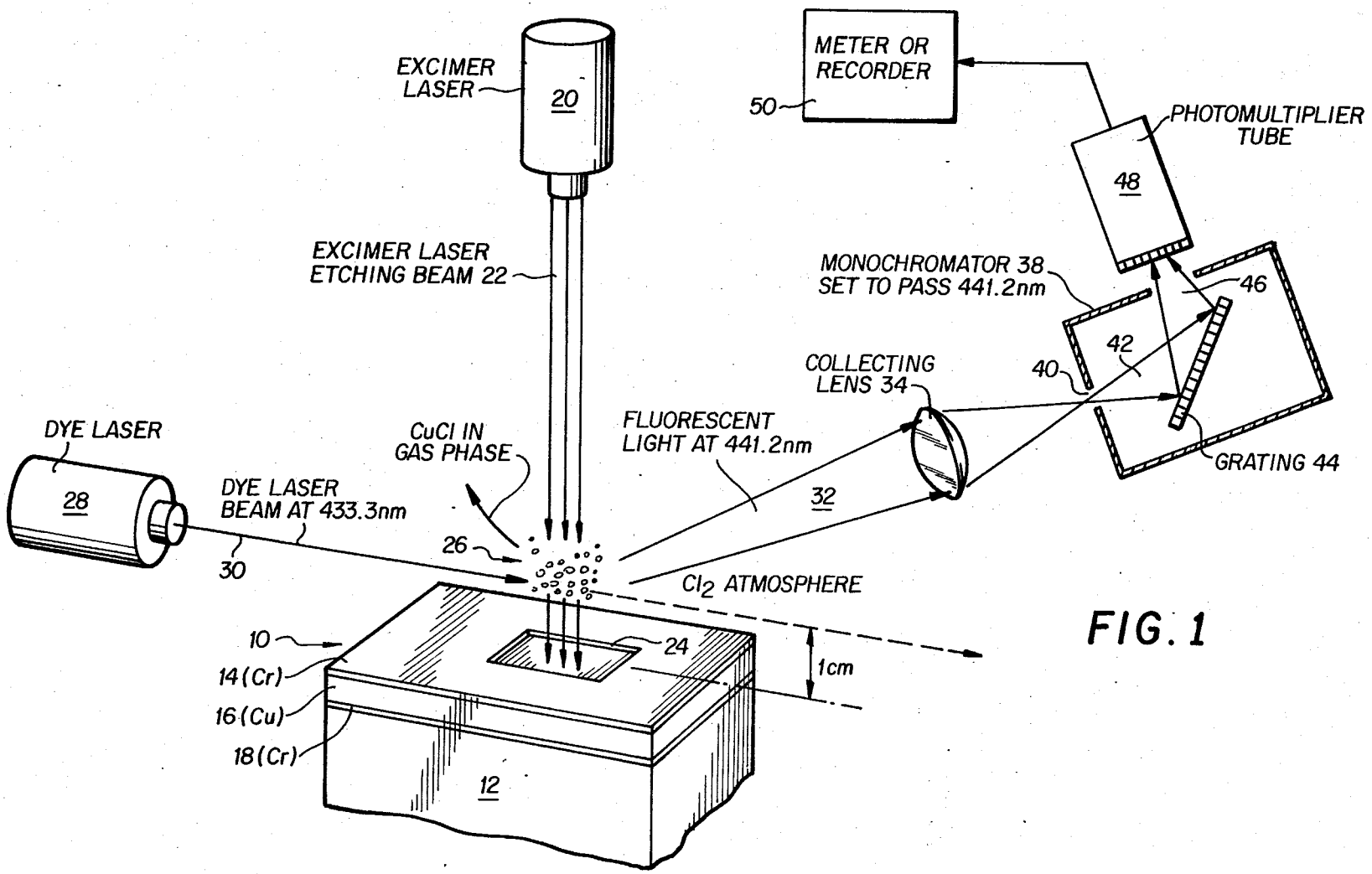
FIG. 1 is a diagrammatic representation of apparatus for etching a substrate and including means for indicating an end point in accordance with a first embodiment of the invention.
Figure 2:
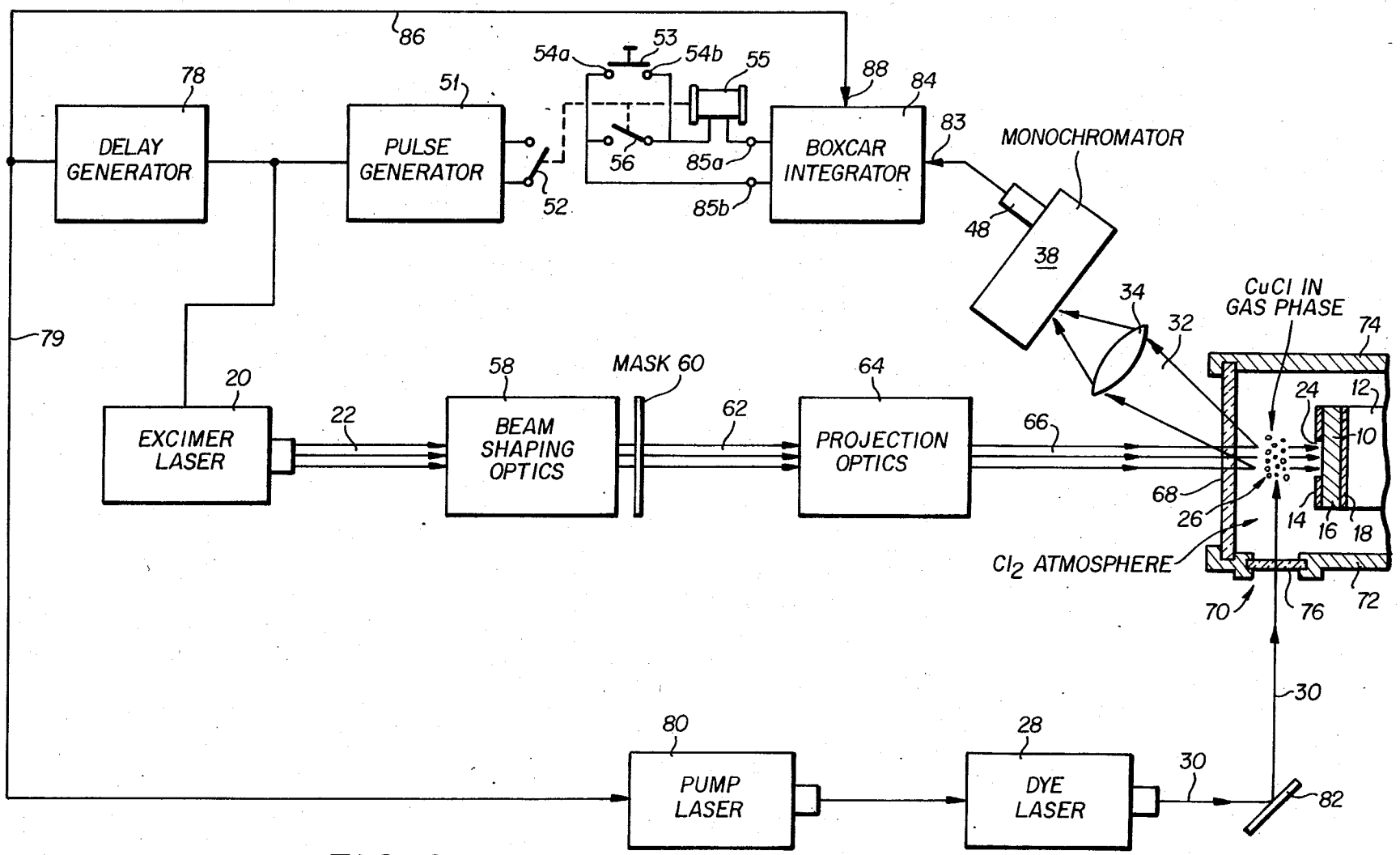
FIG. 2 is a diagrammatic representation of apparatus for etching a substrate and including means for determining an end point and for controlling the etching laser in response thereto in accordance with a second embodiment of the invention.
Figure 3:
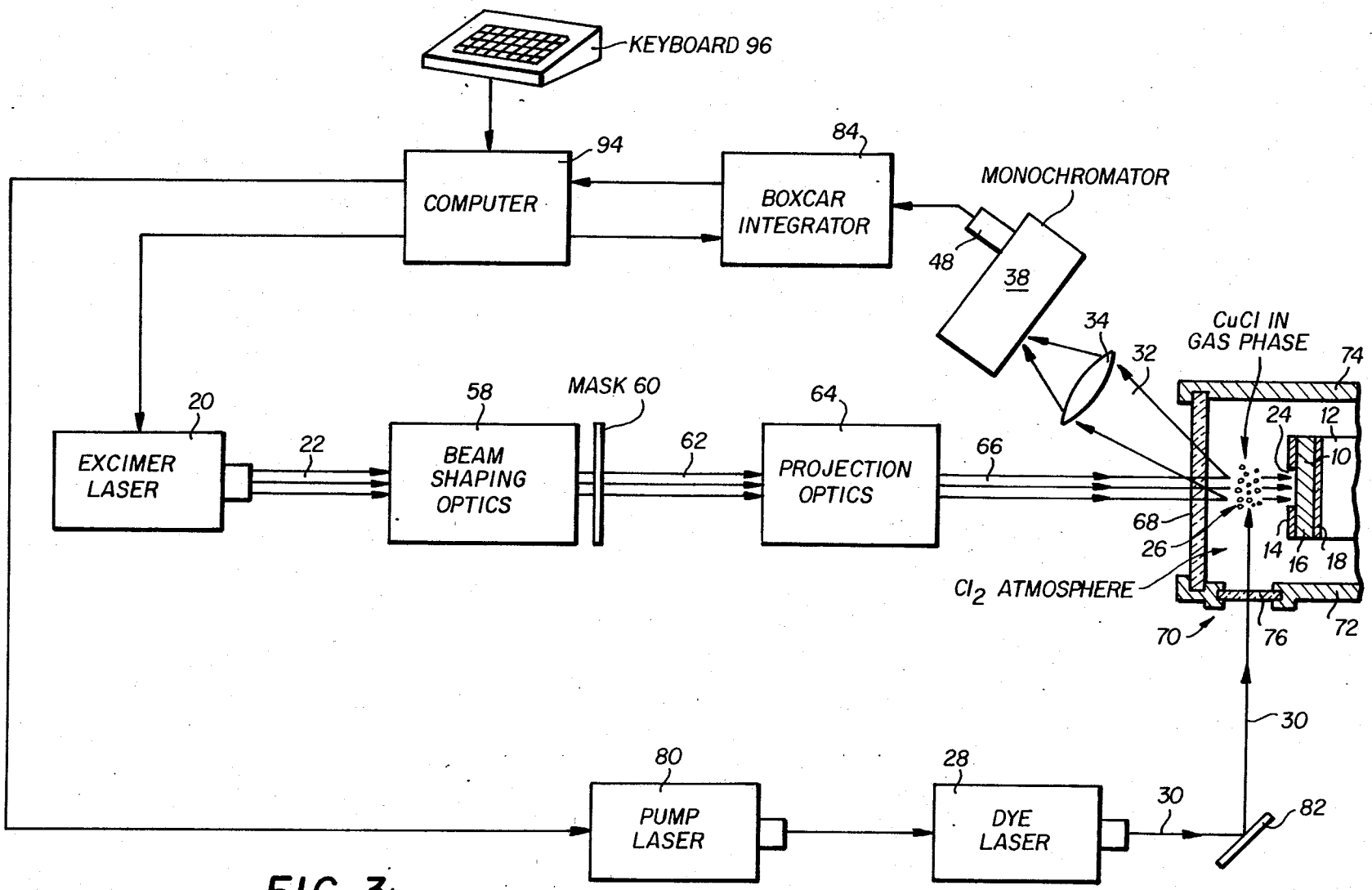
FIG. 3 is a diagrammatic representation of apparatus for etching a substrate and including means for determining an end point and for controlling the etching laser in response thereto in accordance with a third embodiment of the invention.

In the embodiments illustrated in FIGS. 1, 2, and 3, the method and apparatus of the invention are shown as applied to a chromium-copper-chromium substrate. Turning to FIG. 1, the substrate 10 is mounted on a base 12 within a reaction chamber. Substrate 10 includes an upper chromium layer 14 superposed on a copper layer 16 which, in turn, is coated with a second chromium layer 18 on its other side. As explained above, the substrate is exposed to a reactive gas which, in this case, is chlorine; and a thin layer of chromium chloride forms on the exposed surface of chromium layer 14.

An excimer laser 20 directs pulses of an etching laser beam 22 upon a region 24 of the substrate. Laser wavelengths of 193 nm., 248 nm., 308 nm. and 351 nm. are suitable for etching metal chlorides. The chromium chloride layer irradiated by the laser beam is vaporized and driven off, exposing a fresh chromium surface in region 24, which again reacts with the chlorine gas to form a chromium chloride layer. The next laser pulse then removes the newly formed chromium chloride layer. This process of forming a thin layer of chromium chloride on region 24 and removing the layer with an excimer laser pulse continues until all of the chromium layer in region 24 is consumed to expose copper layer 16. The chlorine gas then reacts with the exposed copper in region 24 to form a thin layer of copper chloride. The next excimer laser pulse vaporizes the thin copper chloride layer in region 24 and ejects the copper chloride from region 24 through a detection zone 26 spaced 1 to 2 cm. from region 24 in a direction normal to region 24. If detection zone 26 is spaced at a distance from substrate 10 which is significantly greater than 1 cm., the possibility that the copper chloride will condense on cold surface increases. One can anticipate that detection at greater distances will be less sensitive.

In order to detect when the vaporized reaction product ejected from region 24 is copper chloride, a tunable dye laser 28 is used to direct pulses of a probe beam 30 through region 26. The wavelength of beam 30 is 433.3 nm., selected to match the spectroscopic characteristics of copper chloride. Light of this wavelength is absorbed by copper chloride in its gas phase, inducing the copper chloride to fluoresce light 32 at a wavelength of 441.2 nm. which is unique to copper chloride. In order to maximize the intensity of the fluoresced light of 441.2 nm., the pulsing of dye laser 28 is timed to coincide with the arrival in zone 26 of the vaporized reaction product ejected from region 24. With zone 26 spaced 1 to 2 cm. from region 24, dye laser 28 is timed to pulse 12 microseconds after the pulsing of excimer laser 20. Thus, when copper chloride is the reaction product vaporized by the excimer laser pulse, the copper chloride in gas phase entering zone 26 will absorb the 433.3 nm. light from probe beam 30 and fluoresce light 32 at 441.2 nm. Some of the copper chloride molecules will remain in the gas phase from one etch laser pulse to the next, which increases the sensitivity of the technique.

The 441.2 nm. light is directed by a collecting lens 34 to a monochromator 38 set to pass light of 441.2 nm. wavelength. Monochromator 38 has an aperture 40 receiving the 441.2 nm. light, directing it at 42 to grating 44 from which the light 46 is directed to photomultiplier tube 48. The output from photomultiplier tube 48 is used to drive a meter or recorder 50 which provides an indication that light of 441.2 nm. wavelength has been received and, hence, that the end point in the etching of substrate 10 has been reached.

The detection of the end point can be used to terminate the etching process. The embodiment shown in FIG. 2 has this capability. In FIG. 2, the excimer laser 20 is pulsed by a pulse generator 51 which may, for example, be a programmable pulse generator of the type manufactured by Tektronix. Pulse generator 51 is programmed to generate pulses of a given voltage and frequency. Since the strength of the external signal needed to trigger an excimer laser varies from one laser manufacturer to another, the voltage of the pulses generated should be matched to the requirements for triggering the excimer laser used. While excimer laser 20 may be pulsed at a rate as low as 10 pulses per second, for most applications a laser repetition rate as high as commercially available lasers will allow, which at present is 500 Hz, is used. As explained in Chen et al U.S. Pat. No. 4,490,210, the pulse width of the excimer laser should be in the range of 10 nanoseconds to 650 microseconds, and the intensity should be in the range of 1 to 3 MW/sq. cm. More recently, however, intensities in the range of 7 to 10 MW/sq. cm. have been used successfully.

The laser radiation beam 22 emitted by laser 20 is passed through beam shaping optics 58 and a mask 60 which determines the pattern to be etched. The patterned laser beam 62 is collected by projection optics 64, and a focused image 66 of the mask is projected through the front window 68 of the reaction chamber 70 into which chlorine gas has been introduced. The beam impinges upon substrate 10 to etch a region of the substrate corresponding to the pattern. Substrate 10, which again is a chromium-copper-chromium substrate having a chromium layer 14, a copper layer 16 and a chromium layer 18, is mounted on base 12. Reaction chamber 70 has side walls 72 and 74, and a side window 76 is provided in side wall 72.

Dye laser 28 is pulsed to direct a probe beam 30 of 433.3 nm. reflected by mirror 82 into reaction chamber 70 through side window 76 and into zone 26. Pulse generator 51 pulses dye laser 28 after a delay. This delay, which in the case of zone 26 set at 1 to 2 cm. from substrate 10 is 12 microseconds, is provided in part by a delay generator 78 pulsed by pulse generator 51. The output 79 from delay generator 78 pulses a pump laser 80 after a predetermined delay; and pump laser 80, in turn, triggers dye laser 28. The 12 microsecond delay is the sum of the delay provided by delay generator 78 and the inherent delay in pump laser 80.

When copper chloride formed on the region being etched is vaporized by the etching laser beam 66, the 433.3 nm. probe beam from dye laser 28 is strongly absorbed by the ejected copper chloride gas in zone 26 which then reemits, by fluorescence, light at 441.2 nm. The 441.2 nm. light 32 is collected by collecting lens 34 and passed through monochromator 38, which is set to pass light of the 441.2 nm, wavelength, to photomultiplier tube 48.

With the arrival of the 441.2 nm. light, the output voltage of photomultiplier tube 48 rises and is fed to the input terminal 83 of a boxcar integrator 84 which integrates the signal over a period corresponding to two to three fluorescent lifetimes of the light fluorescing at 441.2 nm. Since this fluorescent lifetime for copper chloride is 0.6 microseconds, the integration period of boxcar integrator is set at 1.2–1.8 microseconds. The integrator is reset by a pulse on line 86 from delay generator 78 applied to terminal 88, which pulse coincides with the pulse on line 79 to pump laser 80. The integrated signal is negative and reduces the voltage output across output terminals 85*a* and 85*b* of the integrator.

This output voltage of integrator 84 serves as a voltage source for a relay circuit including relay 55. Ordinarily, the voltage on the output terminals of integrator 84 is large enough to energize relay 55 when a manual start switch 53 is closed bridging contacts 54*a* and 54*b*. This causes the relay to close power switch 52 of pulse generator 51 to turn on the pulse generator and to close a holding switch 56 to maintain the energization of relay 55. When, however, the photomultiplier tube output signal being integrated becomes large enough to pull down the voltage across output terminals 85*a* and 85*b* below the holding voltage of relay 55, relay 55 opens holding switch 56 and power switch 52 to shut off the pulse generator. With pulse generator 51 shut down, the pulsing of excimer laser 20 ceases; and the etching process is terminated. By properly adjusting boxcar integrator 84, the magnitude of the signal required to release the relay can be adjusted to control the amount of chromium remaining in region 24. It is thus possible to stop the excimer laser immediately after the first copper chloride is detected, when some chromium is still present in region 24, or to stop it later after additional copper and the remaining chromium have been etched and the concentration of copper chloride in the gas phase has increased. Such an increase in copper chloride concentration will cause more intense fluorescence of light at 441.2 nm. and a larger signal output from photomultiplier tube 48.

The chromium chloride has not been observed to absorb at 433.3 nm. Therefore, there is no fluorescence emitted by chromium chloride in the gas phase. For detecting the copper chloride, the laser induced fluorescence technique has a demonstrated sensitivity of 100 angstrom units of copper. There is, thus, very little attack on copper layer 16 before the "stop" signal is generated.

In the embodiment of FIG. 2, a mechanical relay is used to control the shutting down of pulse generator 51. While the speed of operation of the relay is adequate for the case of an excimer laser being pulsed at a relatively low rate, such as 10 times per second, in cases requiring a high pulsing rate it will be necessary to employ a faster acting semiconductor circuit analog of the relay circuit to shut down pulse generator 51.

As illustrated by the embodiment shown in FIG. 3, it is possible to use a computer 94, having a keyboard 96, to automate many of the functions needed to etch the substrate 10 including controlling the firing of excimer laser 20 and controlling the end point detection system. The computer incorporates the functions of pulse generator 51, delay generator 78 and the relay circuit of FIG. 2. The system of FIG. 3 is otherwise identical to the system shown in FIG. 2.

Depending on the type of excimer laser used, computer 94 controls excimer laser 20 in one of two ways. Most current excimer lasers have BNC ports which allow the excimer laser to be triggered by an external signal. For such an excimer laser, a pulse generating card is provided in the computer; and the computer is programmed to send pulses of appropriate voltage and frequency to the laser. A few currently available excimer lasers, and all excimer lasers planned as industrial tools, have a microprocessor built into the laser itself. The laser based microprocessor controls many of the functions of the laser including setting the repetition rate and firing the laser pulses and is designed to interface wwith an external computer. For this type of laser, computer 94 is programmed to interface with and set the repetition rate for the laser based microprocessor and to order the laser microprocessor to fire the laser.

Dye lasers which are computer controlled are now the rule rather than the exception. The programs necessary to run dye laser 28 are adapted to the specific requirements of computer 94. The output voltage from boxcar integrator 84 can either be read directly by computer 94 after appropriate calibration of its data acquisition card or by first sending the output of boxcar integrator 84 through a programmable voltmeter.

In a fully automated system, computer 94 could, in addition to controlling excimer laser 20, dye laser 28, and the end point detection system, control parts changing and handling apparatus and control the atmosphere within reaction cell 70. An operator uses computer 94 to set the repetition rate and output energy at which excimer laser 20 will operate. The operator then initiates the main computer program which controls all aspects of the etching. Computer 94 waits for a signal from the parts handling system that a substrate is in place and ready to be etched before proceeding with laser etching and end point detection. Alternatively, in a semiautomatic system, in which the operator manually places each substrate to be etched in the reaction cell 70, the operator initiates the laser etching and end point detection systems. In either case, after the substrate is in place, computer 94 checks that dye laser 28 is running and producing light at the proper wavelength. In the case of chromium-copper-chromium substrate 10 and chlorine as the reactive gas, the wavelength is set at 433.3 nm. for detection of copper chloride. Whatever corrective action that is necessary is directed by the computer including turning pump laser 80 and dye laser 28 on, tuning dye laser 28 to the proper wavelength, and timing the pulsing of dye laser 28 to fire after a delay following the time of firing of the excimer laser to maximize the intensity of the light fluoresced by copper chloride in gas phase. The delay is selected so that the probe beam 30 from dye laser 28 will pass through a zone 26 spaced from substrate 10 when the reaction product ejected from substrate 10 after vaporization by the excimer laser beam has reached zone 26. As explained above, a delay of 12 microseconds is appropriate for a zone 26 spaced 1 to 2 cm. from substrate 10. Dye laser 28 may be left running, or may be turned off, while substrates are being removed and placed in reaction chamber 70.

After the computer starts firing excimer laser 20, the system operates as explained above in connection with FIG. 2. The voltage appearing at the output of boxcar integrator 84, which is reset by the computer at about the time dye laser 28 is fired, is read by computer 94 and compared to a stored voltage value. At first, when only chromium is being etched and chromium chloride is being ejected from substrate 10, there is no fluorescence at 441.2 nm. and the output of boxcar integrator 84 remains below the stored voltage value in computer 94. The stored voltage value is determined experimentally and is the voltage at which gas phase copper chloride is first detected.

When the chromium layer is etched through, the underlying copper begins to be etched and copper chloride is ejected into the atmosphere above the substrate surface. The copper chloride in gas phase strongly absorbs the 433.3 nm. dye laser light and reemits, by fluorescence, light at 441.2 nm. With the arrival of the 441.2 nm. light, the output voltage of boxcar integrator 84 rises and exceeds the voltage value stored in computer 94. Once computer 94 senses that the output voltage from boxcar integrator 84 is greater than the stored voltage value, the computer either immediately stops excimer laser 20 from pulsing or pulses excimer laser 20 for a set number of additional pulses to remove all of the residual chromium from region 24 before stopping the laser.

In the above described embodiments, the invention has been described as applied to the detection of a copper chloride reaction product in gas phase. It is to be understood, however, that other reaction products, which may be formed by a reactive gas when an overlying layer is etched through to expose an underlying layer in the above described etching process, may be detected as well by tuning the dye laser to an appropriate excitation wavelength and by selecting a monochrometer tuned to pass the luminescent light emitted by the reaction product. The following table contains an exemplary list of such reaction products along with the wavelength of the excitation probe beam required and the wavelength of the luminescent light emitted:

| Reaction Product | Excitation Wavelength (in nm.) | Wavelength of Light Emitted (in nm.) |
|---|---|---|
| CuBr | 481.04 | 488.34 |
| CH | 362.72 | 402.53 |
| CuFl | 490.13 | 505.23 |
| SiN | 381.4 | 416.96 |
| AlO | 447.04 | 467.19 |
| SiO | 221.54 | 280.63 |
| Any $C_2$ group polymer | 438.25 | 554.07 |

In the embodiments of FIGS. 2 and 3, the pulsing of dye laser 28 is keyed to occur at a fixed delay after the pulsing of the excimer laser. However, the pulsing of the dye laser need not be synchronized to the pulsing of the excimer laser: it is only necessary that at least one of the dye laser pulses coincide with the time of arrival of ejected reaction product in zone 26.

It is possible to use light sources other than dye lasers as the probe beam source. For example, properly tuned resonance lamps could be used. However, the sensitivity will probably be too low and slow for most purposes.

Instead of using a monochromator to select the specific fluorescence wavelength for the photomultiplier tube, narrow band optical filters could be used.

While the invention has been shown and described with respect to preferred embodiments thereof, it will be understood by those skilled in the art that various changes in form and detail may be made therein without departing from the spirit and scope of the invention.

We claim:

1. A method of radiation induced dry etching of a substrate having a layer of a first material superposed on a second material comprising:

(a) mounting said substrate in a reaction chamber containing a reactive gas, whereby said first material and said reactive gas form a first solid reaction product layer of said first material and said reactive gas on said first material by at least partial consumption of said layer of first material;

(b) pulsing etching laser means to apply, in a predetermined pattern corresponding to a region of said substrate, a beam of laser radiation to said region to vaporize said first solid reaction product layer in said region and eject said first reaction product in a gas phase from said region to expose said layer of first material which again forms a layer of said first solid reaction product with said reactive gas in said region and pulsing said etching laser means repeatedly to vaporize successive first solid reaction product layers from said region after they form following successive vaporizations thereof to expose said first material and, after all of said first material in said region has been removed, to vaporize a second solid reaction product layer formed in said region by said second material and said reactive gas;

(c) after a delay following each pulsing of said etching laser means, pulsing probe beam means to direct a probe beam of narrow band light into a zone spaced from said region of said substrate, said delay being of such magnitude that said vaporized reaction products ejected from said region have reached said zone, said light of said probe beam having a first wavelength which induces said vaporized second reaction product in said zone to fluoresce light at a second wavelength unique to said second reaction product; and (d) detecting said light of said second wavelength as an indication that all of said first material has been removed from said region of said substrate.

2. A method as recited in claim 1, further comprising the step of terminating said pulsing of said etching laser means in response to detection of said light of said second wavelength.

3. A method as recited in claim 1, where said etching laser means is an excimer laser and said radiation has a third wavelength.

4. A method as recited in claim 1, wherein said probe beam means is a dye laser.

5. A method as recited in claim 1, wherein said first material is chromium, said second material is copper, said reactive gas is chlorine, said first reaction product is chromium chloride, and said second reaction product is copper chloride.

6. A method as recited in claim 5, wherein said first wavelength is 433.3 nm. and said second wavelength is 441.2 nm.

7. A method as recited in claim 6, further comprising the step of terminating said pulsing of said etching laser means in response to detection of light of said 441.2 nm. wavelength.

8. A method as recited in claim 1, wherein said zone is spaced between 1 to 2 cm. from the surface of said region of said substrate and said delay is substantially 12 microseconds.

9. A method as recited in claim 1, wherein said step of detecting said light of said second wavelength comprises generating a signal in response to said light of said second wavelength and integrating said signal over a period of time, said period of time being two to three times the fluorescent lifetime of said light of said second wavelength.

10. Apparatus for radiation induced dry etching of a substrate having a layer of a first material superposed on a second material, comprising:

(a) a reaction chamber within which said substrate is mounted, said reaction chamber containing a reactive gas which forms a first solid reaction product layer of said first material and said reactive gas by at least partial consumption of said layer of said first material;

(b) etching laser means for directing an etching beam in a predetermined pattern upon a region of said substrate to remove selectively the first reaction product layer by vaporization to expose said layer of first material, said etching laser means, being pulsed repeatedly to vaporize successively said first reaction product layer from said region after it forms following successive vaporizations thereof to expose said first material and, after all of said first material in said region is removed, to vaporize a second solid reaction product layer formed by said second material and said reactive gas in said region;

(c) probe beam means for directing a probe beam of narrow band light into a zone spaced from said region of said substrate, said probe beam means being pulsed after a delay following each pulsing of said etching laser means, said delay being of such magnitude that said vaporized reaction products ejected from said region have reached said zone, said light of said probe beam having a first wavelength which induces said vaporized second reaction product in said zone to fluoresce light at a second wavelength unique to said second reaction product; and (d) detecting means for detecting said light of said second wavelength as an indication that all of said first material has been removed from said region of said substrate.

11. Apparatus as recited in claim 10, further comprising means to terminate said pulsing of said etching laser in response to detection of said light of said second wavelength.

12. Apparatus as recited in claim 10, wherein said means of detecting said light of said second wavelength comprises a monochrometer tuned to said second wavelength and a photosensor.

13. Apparatus as recited in claim 12, wherein said photosensor generates a signal in response to said light of said second wavelength, and wherein said apparatus further comprise an integrator integrating said signal over a time period which is two to three times greater than the fluorescent lifetime of said light of said second wavelength.

14. Apparatus as recited in claim 10, wherein said probe beam means comprises a dye laser.

15. Apparatus as recited in claim 10, wherein said etching laser means is an excimer laser and said etching beam has a third wavelength.

16. Apparatus as recited in claim 10, wherein said first material is chromium, said second material is copper, said reactive gas is chlorine, said first reaction product is chromium chloride, said second reaction product is copper chloride, said first wavelength is 433.3 nm. and said second wavelength is 441.2 nm.

17. Apparatus as recited in claim 16, further comprising means for terminating said pulsing of said excimer laser in response to detection of said light of said 441.2 nm. wavelength.

18. Apparatus as recited in claim 10, wherein said zone is spaced 1 to 2 cm. from the surface of said region of said substrate and said delay is substantially 12 microseconds.

19. A method of radiation induced dry etching of a substrate having a layer of a first material superposed on a second material, comprising:

(a) mounting said substrate in a reaction chamber containing a reactive gas, whereby said first material and said reactive gas form a first solid reaction product layer of said first material and said reactive gas on said first material by at least partial consumption of said layer of first material;

(b) pulsing etching laser means to apply, in a predetermined pattern corresponding to a region of said substrate, a beam of laser radiation to said region to vaporize said first solid reaction product layer in said region and eject said first reaction product in a gas phase from said region to expose said layer of first material which again forms a layer of said first solid reaction product with said reactive gas in said region and pulsing said etching laser means repeatedly to vaporize successive first solid reaction product layers from said region after they form following successive vaporizations thereof to expose said first material and, after all of said first material in said region has been removed, to vaporize a second solid reaction product layer formed in said region by said second material and said reactive gas;

(c) pulsing probe beam means to direct a probe beam of narrow band light into a zone spaced from said region of said substrate, said pulsing of said probe beam being timed to coincide with the time of arrival in said zone of said vaporized reaction products ejected from said region, said light of said probe beam having a first wavelength which induces said vaporized second reaction product in said zone to fluoresce light at a second wavelength unique to said second reaction product; and (d) detecting said light of said second wavelength as an indication that all of said first material has been removed from said region of said substrate.

20. A method as cited in claim 19, further comprising the step of terminating said pulsing of said etching laser means in response to detection of said light of said second wavelength.

* * * * *